US010240317B2

(12) United States Patent
Emanuel

(10) Patent No.: US 10,240,317 B2
(45) Date of Patent: Mar. 26, 2019

(54) COVER ASSEMBLY

(71) Applicant: TRUMBULL MANUFACTURING, INC., Youngstown, OH (US)

(72) Inventor: Blake Emanuel, Girard, OH (US)

(73) Assignee: TRUMBULL MANUFACTURING, INC., Youngstown, OH (US)

( * ) Notice: Subject to any disclaimer, the term of this patent is extended or adjusted under 35 U.S.C. 154(b) by 88 days.

(21) Appl. No.: 15/289,526

(22) Filed: Oct. 10, 2016

(65) Prior Publication Data

US 2018/0100285 A1 Apr. 12, 2018

(51) Int. Cl.
*E02D 29/14* (2006.01)

(52) U.S. Cl.
CPC ..... *E02D 29/149* (2013.01); *E02D 29/1445* (2013.01)

(58) Field of Classification Search
CPC ..... E02D 29/14; E02D 29/149
USPC ..... 404/25, 24; 52/19, 20
See application file for complete search history.

(56) References Cited

U.S. PATENT DOCUMENTS 660,731 A * 10/1900 McLam
1,152,618 A * 9/1915 Farris ..... B60K 15/0406 220/298
4,523,407 A * 6/1985 Miller ..... F16J 13/08 404/25
4,723,866 A * 2/1988 McCauley ..... E02D 29/1427 404/25
4,763,449 A * 8/1988 Vigneron ..... E02D 29/14 220/301
4,861,186 A * 8/1989 Ferns ..... E02D 29/14 404/25
4,934,715 A * 6/1990 Johnson ..... E02D 29/14 220/378
5,165,819 A * 11/1992 Bowman ..... E02D 29/124 404/26
5,316,407 A * 5/1994 Miller ..... E02D 29/14 404/25
5,318,376 A * 6/1994 Prescott, Sr. ..... E02D 29/1445 404/25
5,797,221 A * 8/1998 Young ..... E02D 29/14 404/25
5,974,741 A * 11/1999 Fukuhara ..... E02D 29/1409 404/25
6,035,581 A * 3/2000 McCoy ..... E02D 29/1427 404/25
D428,159 S * 7/2000 McCoy ..... D25/102
6,371,688 B1 * 4/2002 Yang ..... E02D 29/1409 404/25
6,688,806 B2 * 2/2004 Kuan ..... E02D 29/1409 404/25
7,030,315 B1 * 4/2006 Dunn ..... H02G 9/10 174/17 R (Continued)

*Primary Examiner* — Thomas B Will
*Assistant Examiner* — Katherine J Chu
(74) *Attorney, Agent, or Firm* — Tucker Ellis LLP

(57) ABSTRACT

The present application provides a cover assembly having a frame and a cover removably connected to the frame. The cover is sealed to the frame by a sealing device, and the cover is removably connected to the frame by fasteners without interfering with the seal to prevent leakage through the area around the fasteners. The frame and cover each also have a plurality of alignment indicators that are aligned with one another to assist an operator in securing the cover to the frame.

15 Claims, 12 Drawing Sheets

(56) References Cited

U.S. PATENT DOCUMENTS

| | | | | |
|---|---|---|---|---|
| 7,144,189 | B1 * | 12/2006 | Bongiovanni | B65D 90/105 404/25 |
| 7,712,515 | B2 * | 5/2010 | Sulak | E02D 29/1427 164/222 |
| 7,905,679 | B2 * | 3/2011 | Vrondran | E02D 29/1445 137/371 |
| 9,551,141 | B2 * | 1/2017 | Clinton | E03F 5/041 |
| 2009/0180832 | A1 * | 7/2009 | Vrondran | E02D 29/1427 404/25 |
| 2013/0011194 | A1 * | 1/2013 | Lorenz | E02D 29/14 404/25 |

* cited by examiner

COVER ASSEMBLY

FIELD OF INVENTION

The present invention relates generally to a cover assembly, and more particularly to a manhole cover assembly for a manhole.

BACKGROUND

Removable covers are used to cover a manhole to keep unauthorized persons and materials out of a public utility access, such as for water, gas, sewer, and electric industries, and to minimize accidents and injuries resulting from the placement of manholes. The covers can be made from cast iron, concrete, or a combination thereof. These manhole covers are subject to theft, and injuries are caused to workers stemming from the weight and difficulty related to the moving and transporting of the manhole covers.

SUMMARY OF INVENTION

The present application provides a cover assembly having a frame and a cover removably connected to the frame. The cover is sealed to the frame by a sealing device, and the cover is removably connected to the frame by fasteners without interfering with the seal to prevent leakage through the area around the fasteners. The frame and cover each also have a plurality of alignment indicators that are aligned with one another to assist an operator in securing the cover to the frame.

According to one embodiment, a cover assembly is provided that includes a frame including a body having an upper surface, a lower surface, an outer surface, and an inner surface defining a through passage, and a lip extending inward or outward from the inner surface around a circumference of the inner surface, the lip having an upper surface defining a circumferential groove, a sealing device disposed within the groove, and a cover configured to be removably connected to the frame, wherein a lower surface of the cover is configured to abut the upper surface of the lip and seal to the frame via the sealing device, wherein the cover is configured to be removably connected to the frame without interfering with the seal.

According to another embodiment, a cover assembly is provided that includes a frame including a body having an upper surface with a plurality of circumferentially spaced body alignment indicators, a lower surface, an outer surface, and an inner surface defining a through passage, and a lip extending inward or outward from the inner surface around a circumference of the inner surface and including a plurality of circumferentially spaced openings in its upper surface respectively aligned with one of the plurality of circumferentially spaced body alignment indicators, and a cover configured to be removably connected to the frame, the cover having an upper surface with a plurality of circumferentially spaced cover alignment indicators, a lower surface configured to abut the upper surface of the lip, and a plurality of circumferentially spaced openings respectively aligned with one of the plurality of circumferentially spaced cover alignment indicators and extending through the cover, wherein each of the cover alignment indicators is configured to be aligned with one of the body alignment indicators to align the openings in the cover with the openings in the lip.

According to still another embodiment, a cover assembly is provided that includes a frame having a body having an upper surface with a plurality of circumferentially spaced body alignment indicators, a lower surface, an outer surface, and an inner surface defining a through passage, a lip extending inward or outward from the inner surface around a circumference of the inner surface, the lip having an upper surface defining a circumferential groove, a sealing device disposed within the groove, and a cover configured to be removably connected to the frame, the cover having an upper surface with a plurality of circumferentially spaced cover alignment indicators and a lower surface configured to abut the upper surface of the lip, wherein each of the alignment indicators on the cover is configured to be aligned with one of the alignment indicators on the body.

The foregoing and other features of the application are described below with reference to the drawings.

DETAILED DESCRIPTION

Figure 1:
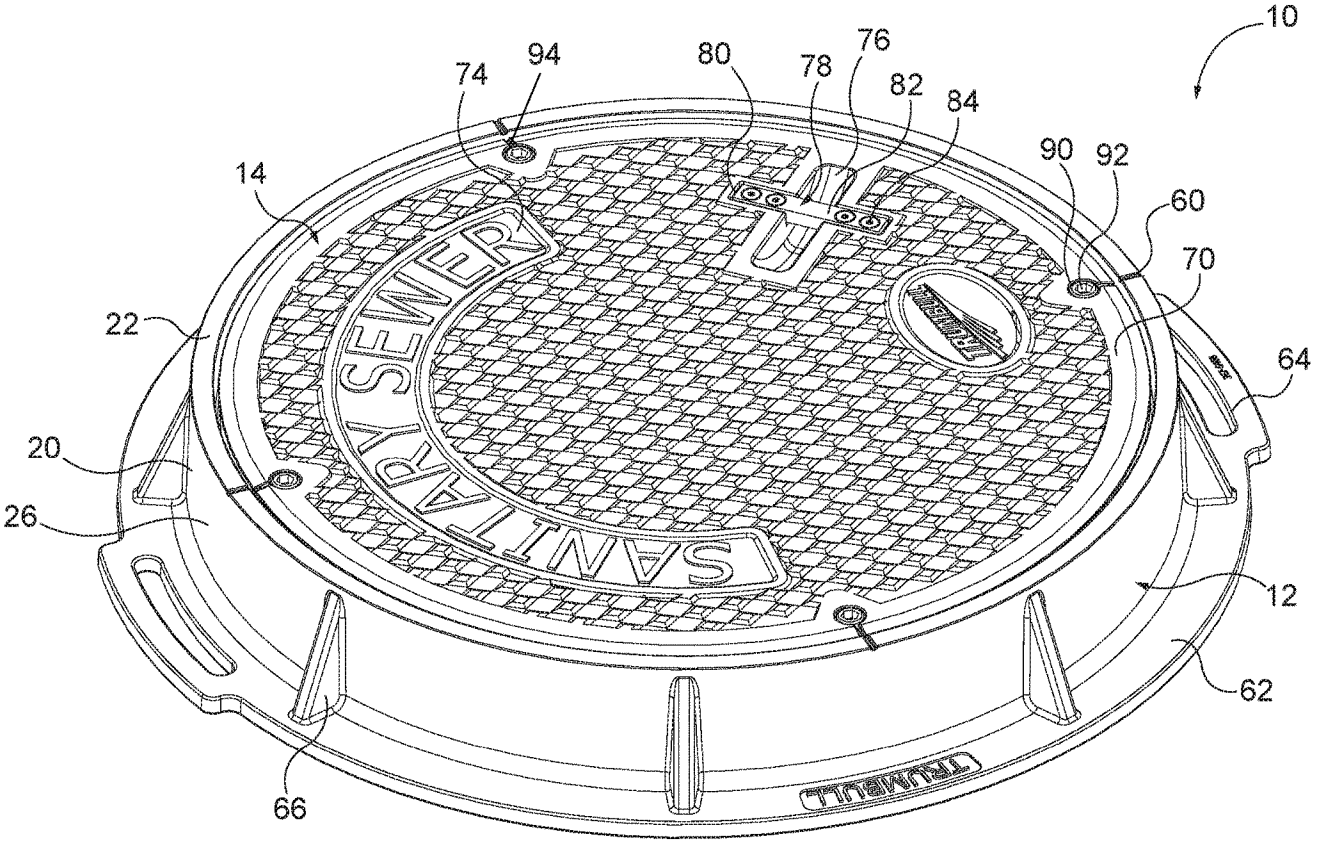
FIG. 1 is a top perspective view of an exemplary cover assembly.

The principles of the present application relate to a cover assembly for covering an opening, such as a manhole cover assembly for covering a manhole, for example of a sanitary sewer or storm sewer and thus will be described below in this context. It will be appreciated that the principles of the application may be applicable to other covers, such as meter box covers, electrical box covers, gas covers, television covers, steam covers, etc.

Turning initially to FIGS. 1-6, an exemplary cover assembly is illustrated generally at reference numeral 10. The cover assembly 10 may be provided for covering a manhole, such as a manhole in a road, to keep unauthorized persons and materials out of a sewer. The cover assembly 10 includes a frame 12 that is secured to the manhole and a cover 14 that is removably connected to the frame 12. The frame 12 and cover 14 may be made of any suitable material, such as a corrosion resistant polymer that allows for the transmission of wireless signals to pass through the cover 14. The polymer frame 12 and cover 14 weigh less than a comparable cast iron frame and cover, such as one third of the weight of the comparable cast iron frame and cover, to reduce back and hand injuries. The cover assembly 10 has a load rating of at least 20,000 pounds, and in an embodiment, the load rating is greater than 50,000 pounds.

Figure 7:
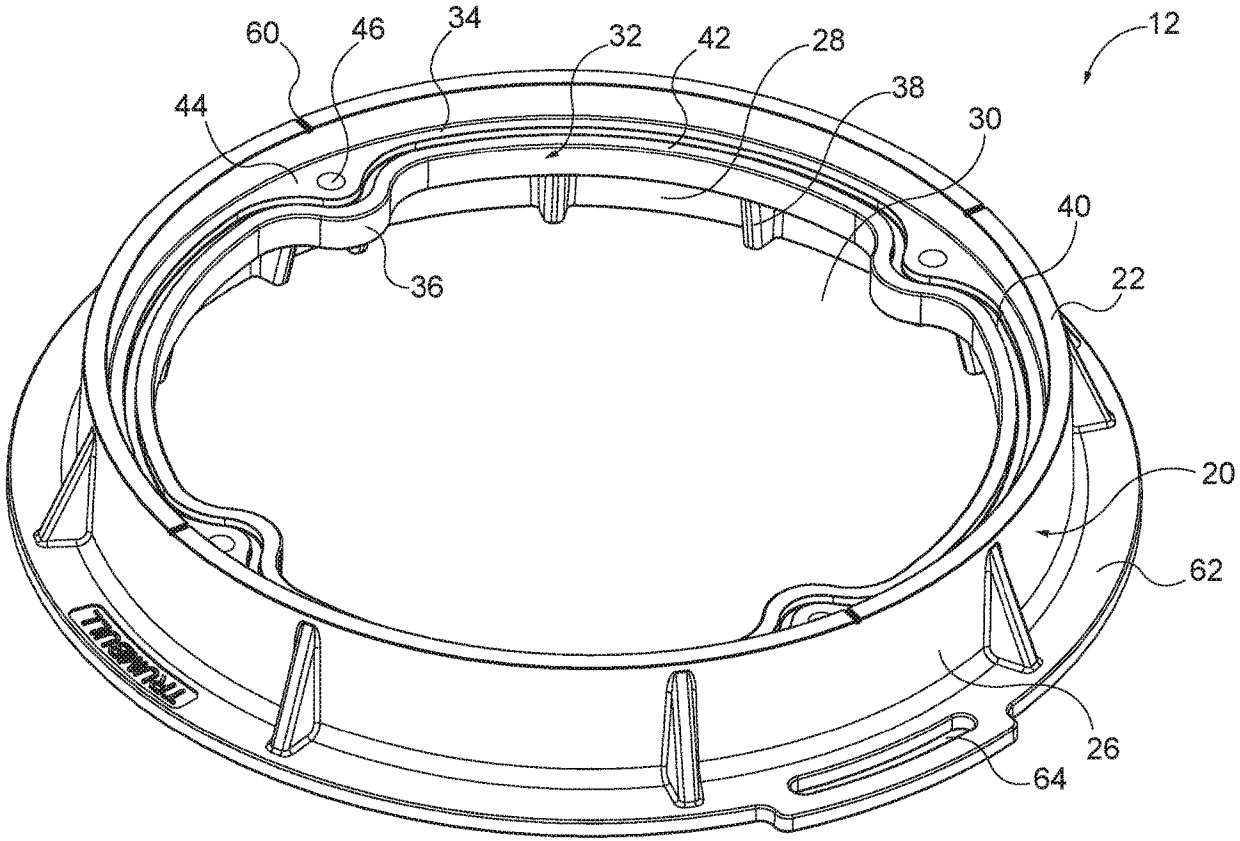
FIG. 7 is a top perspective view of a frame of the cover assembly.
Figure 8:
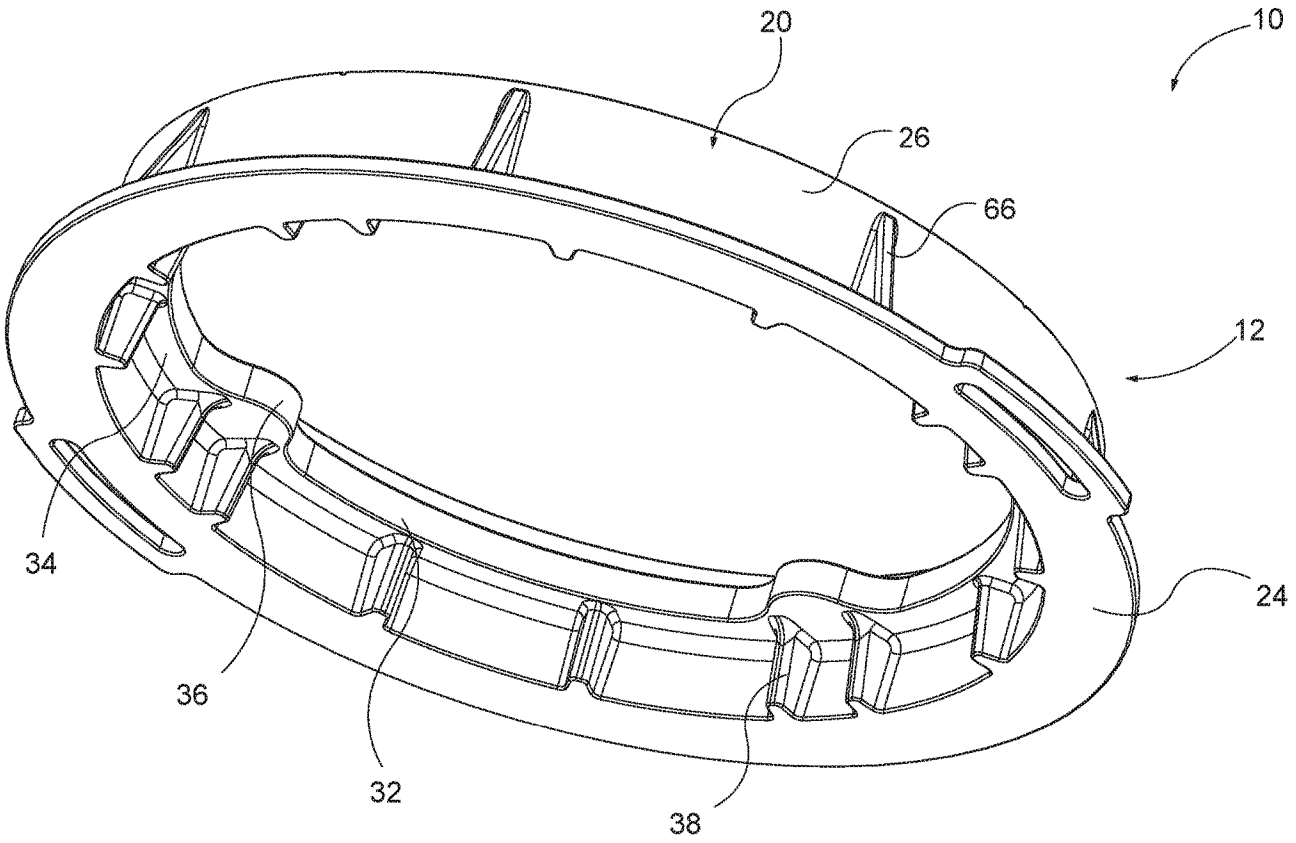
FIG. 8 is a bottom perspective view of the frame.
Figure 9:
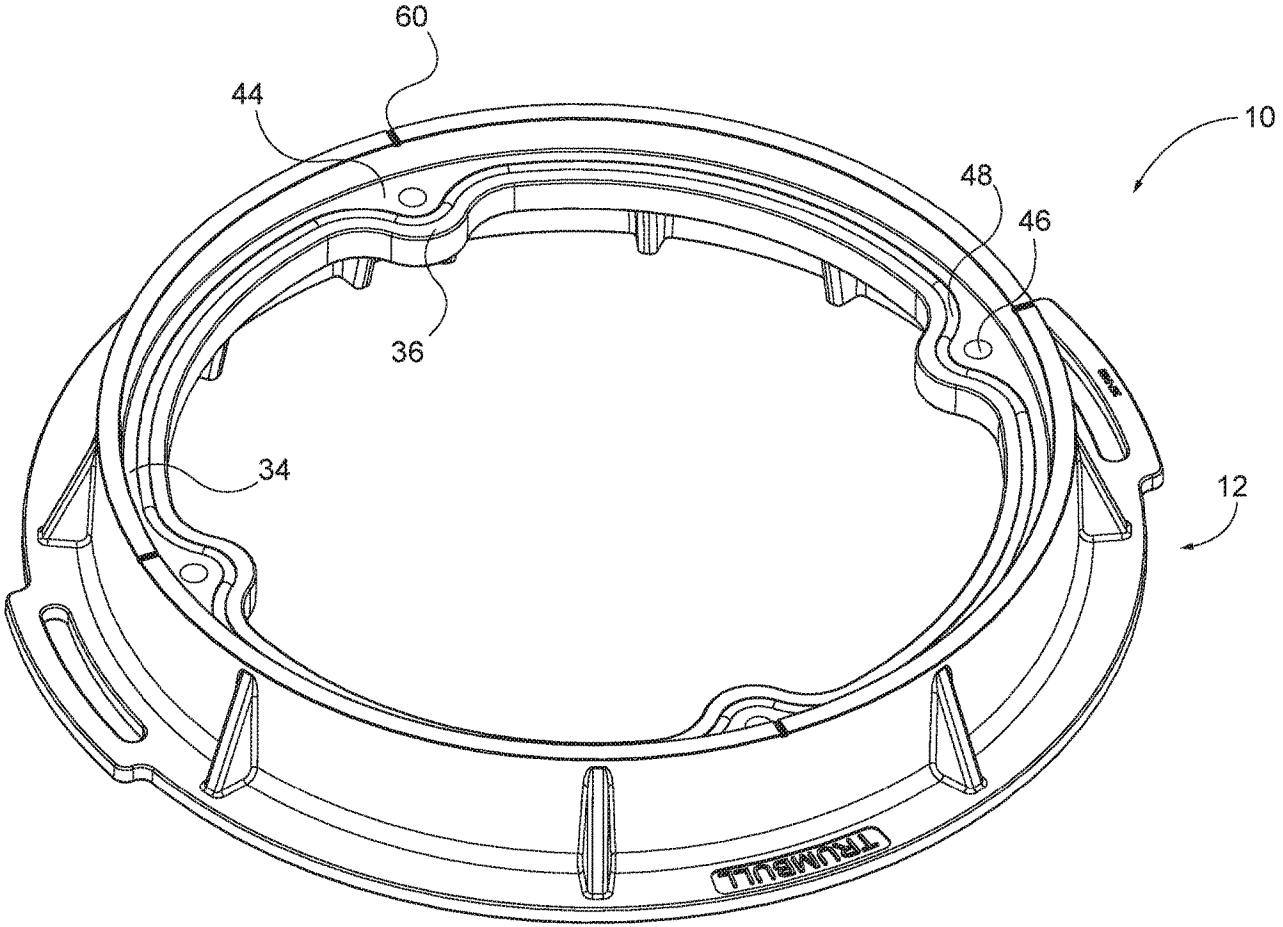
FIG. 9 is a top perspective view of the frame with a sealing device disposed in a seal groove.

Referring now to FIGS. 7-9, the frame 12 includes a body 20 having an upper surface 22, a lower surface 24, an outer surface 26, and an inner surface 28 defining a through passage 30, and a lip 32 extending inward from the inner surface 28 around a circumference of the inner surface 28. The lip 32 is perpendicular to the inner surface 28 and spaced below the upper surface 22 of the body 20 and configured to be abutted by the cover 14 such that the cover is substantially flush with the upper surface 22. The lip 32 includes a main body portion 34 extending inward from the inner surface 28 and a plurality of circumferentially spaced lobes 36 extending inward from the main body portion 34. In the illustrated embodiment the lip 32 includes four lobes 36 equally spaced from one another, although it will be appreciated that any suitable number of lobes may be provided in any suitable orientation, and in an embodiment the lobes may extend inward from the main body portion. Below the lip 32 is one or more supports 38, and in the illustrated embodiment a plurality of circumferentially spaced supports that abut a lower surface of the lip and the inner surface 28 of the body to support the lip 32.

A circumferential seal groove 40 extends around an upper surface 42 of the lip 32 spaced from the inner surface 28 of the body 20 such that the circumferential groove 40 extends inward with the lobes 36. This arrangement forms securement areas 44 on the upper surface 42 of the lip 32 between the circumferential groove 40 and the inner surface 28 of the body 20. An opening 46 is formed in each of the securement areas 44 for receiving a fastener to removably connect the cover 14 to the frame 12 as will be discussed in detail below. The openings 46 are shown extending into the lip 32 but not through the lip 32 to prevent infiltration of unwanted substances, such as fluid, from passing through the openings 46 into the sewer. The plurality of circumferentially spaced lobes 36 extend inward to provide space for the securement areas 44 but extend inward a distance that would not interfere with a user when the user accesses the manhole.

Figure 11:
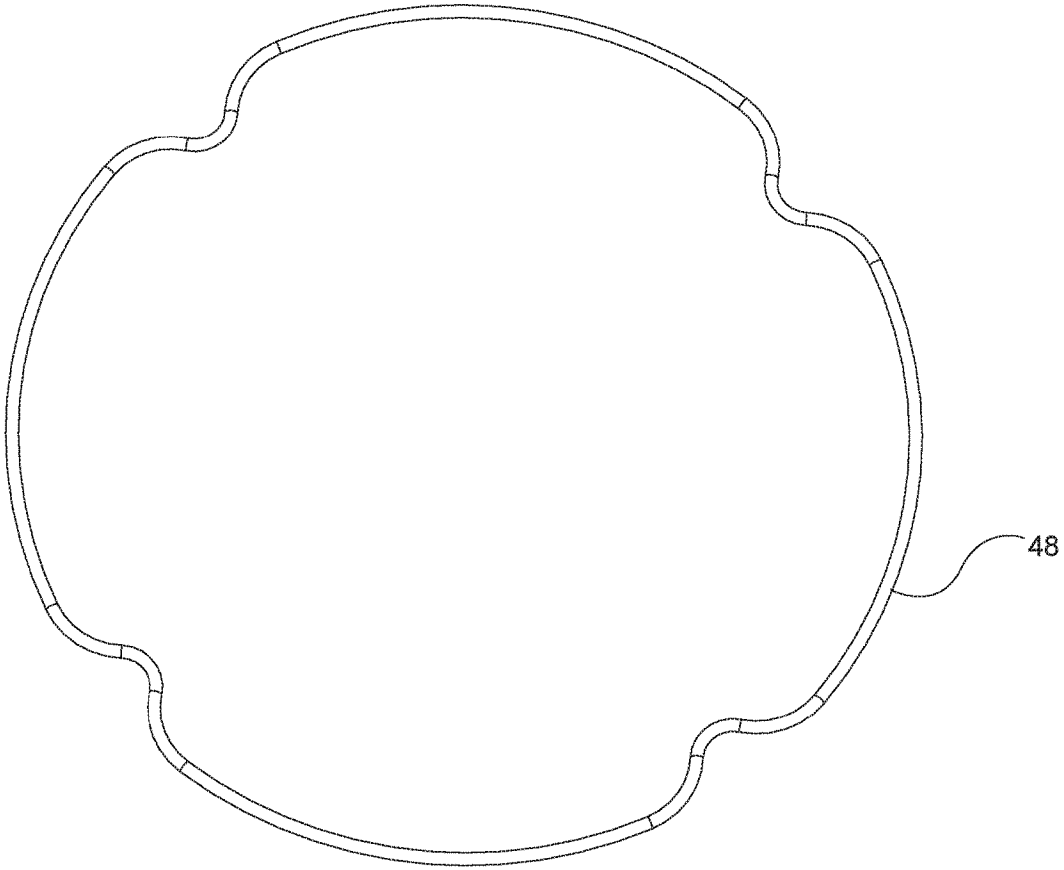
FIG. 11 is a top view of the sealing device.

To prevent infiltration of unwanted substances between the cover 14 and the frame 12, a sealing device 48, such as a suitable seal shown in FIGS. 9 and 11 is disposed within the seal groove 40. The seal 48 may be a continuous seal having the same geometry as the seal groove 40, such as a clover shape as shown. When the cover 14 abuts the upper surface 42 of the lip 32, the weight of the cover 14 compresses the seal 48 to create a seal between the cover 14 and the frame 12. Additionally or alternatively, when the cover 14 is coupled to the frame 12, the seal is further compressed. By positioning the openings 46 in the securement areas 44 outwardly spaced from the seal 48, the cover 14 can be sealed to the frame 12 and coupled to the frame 12 without interfering with the seal created.

The body 20 additionally includes one or more alignment indicators 60, and in the illustrated embodiment a plurality of alignment indicators 60 on the upper surface 22 of the body 20. The alignment indicators 60 are circumferentially spaced around the upper surface 22, and as illustrated, equally spaced. Each alignment indicator 60 is aligned with one of the openings 46 along a line parallel to a plane of the upper surface 22. As illustrated, each alignment indicator 60 is adjacent one of the openings 46 and vertically spaced from the respective opening 46. The alignment indicators 60 are shown as indentations in the upper surface 22 of the body 20, although it will be appreciated that the alignment indicators 60 may be any suitable indicator, such as a line, a geometric shape, a raised portion, etc.

The frame 12 may also include a flange 62 extending around the outer surface 22 of the body 20 and defining the lower surface 24 of the body 20. The flange 62 includes one or more slots 64, and in the illustrated embodiment a pair of slots 64 on opposite sides of the body 20 for anchoring the frame 12 to the manhole. The slots 64 may receive a suitable fastener, such as a bolt, stake, etc., and may be any suitable shape. A plurality of supports 66 may be provided between the flange 62 and the outer surface 26 of the body 20 for supporting the assembly 10 when weight is applied.

Figure 2:
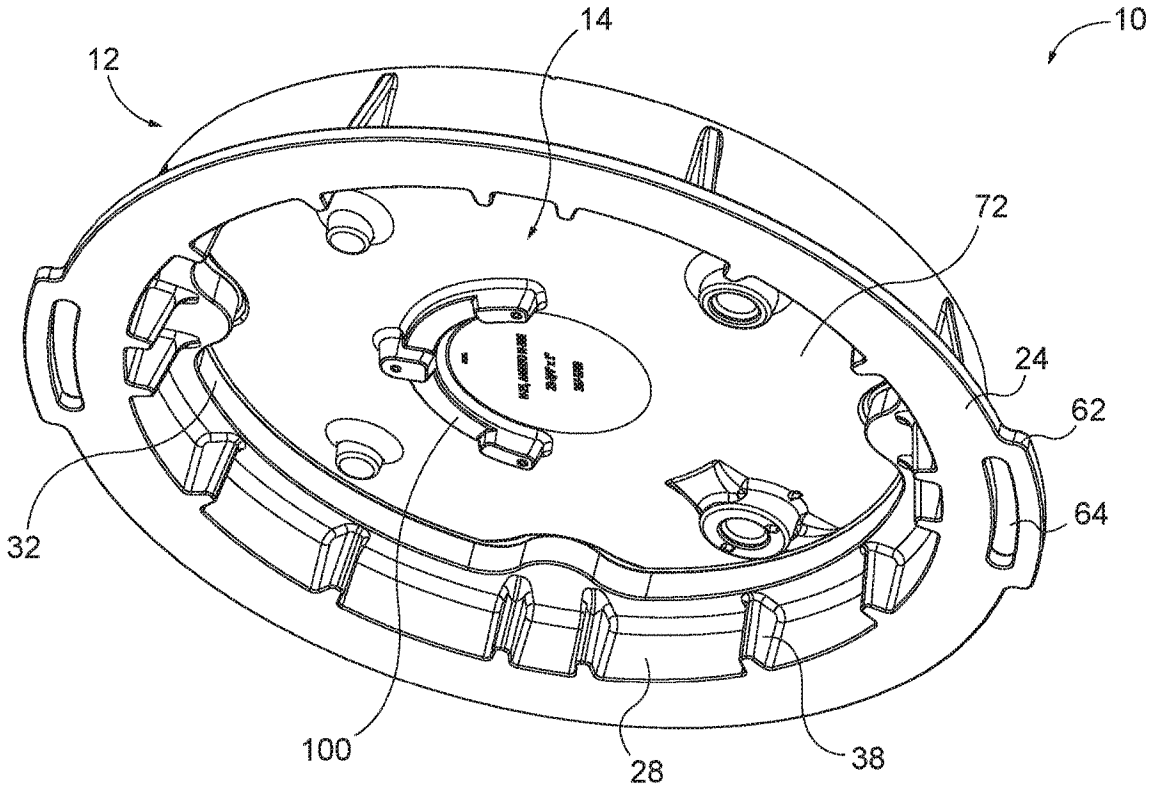
FIG. 2 is a bottom perspective view of the cover assembly.
Figure 3:
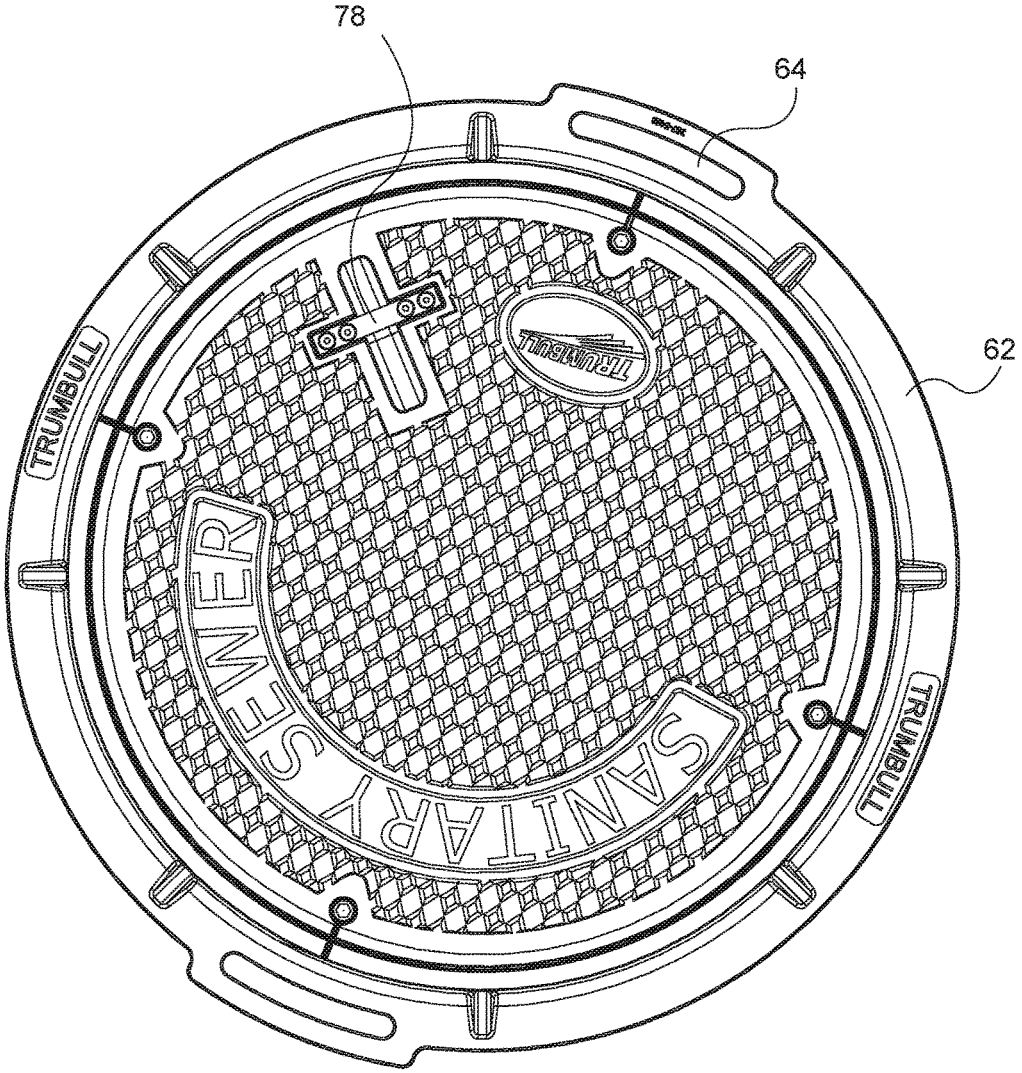
FIG. 3 is a top view of the cover assembly.
Figure 4:
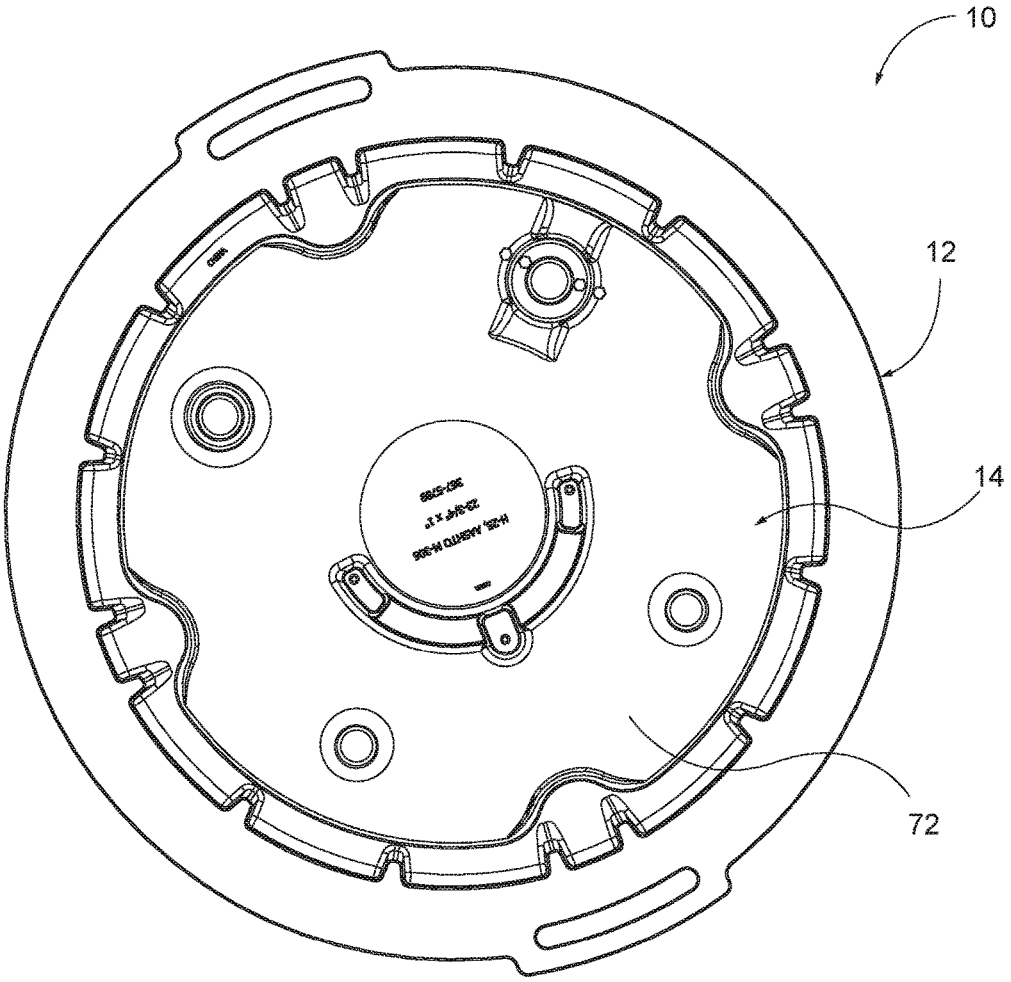
FIG. 4 is a bottom view of the cover assembly.
Figure 5:
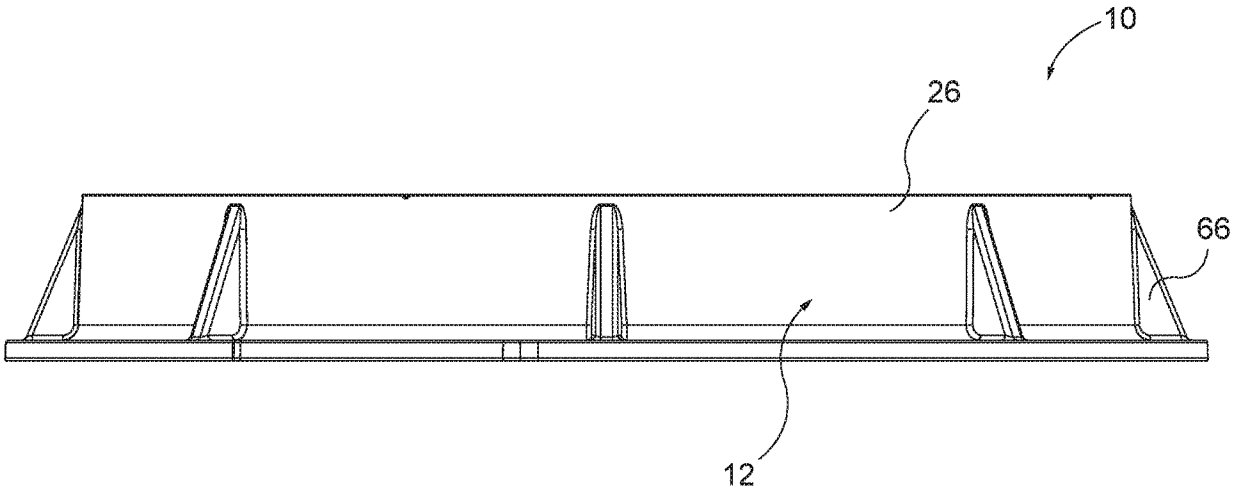
FIG. 5 is a front view of the cover assembly.
Figure 6:
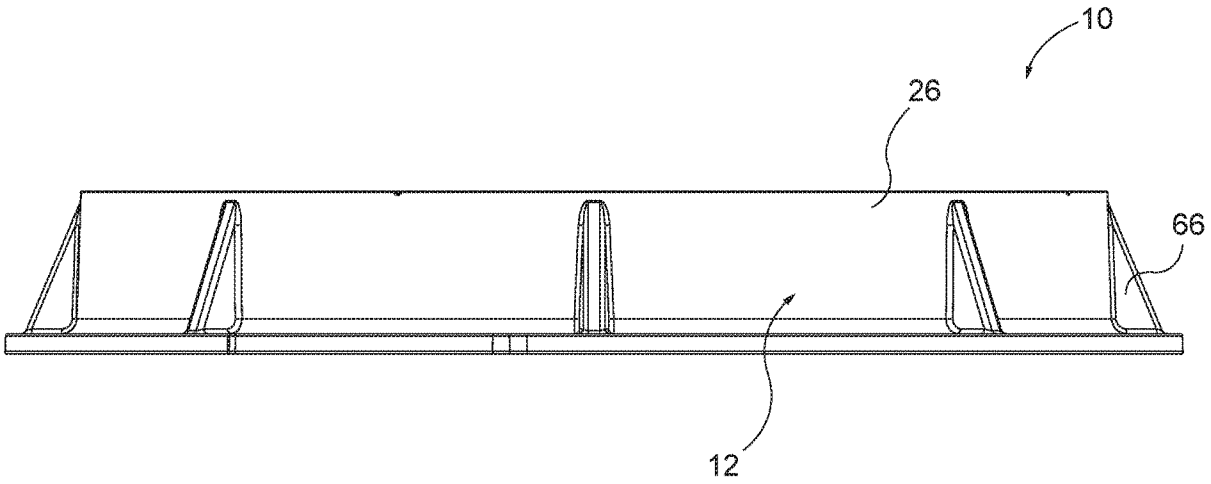
FIG. 6 is a rear view of the cover assembly.
Figure 10:
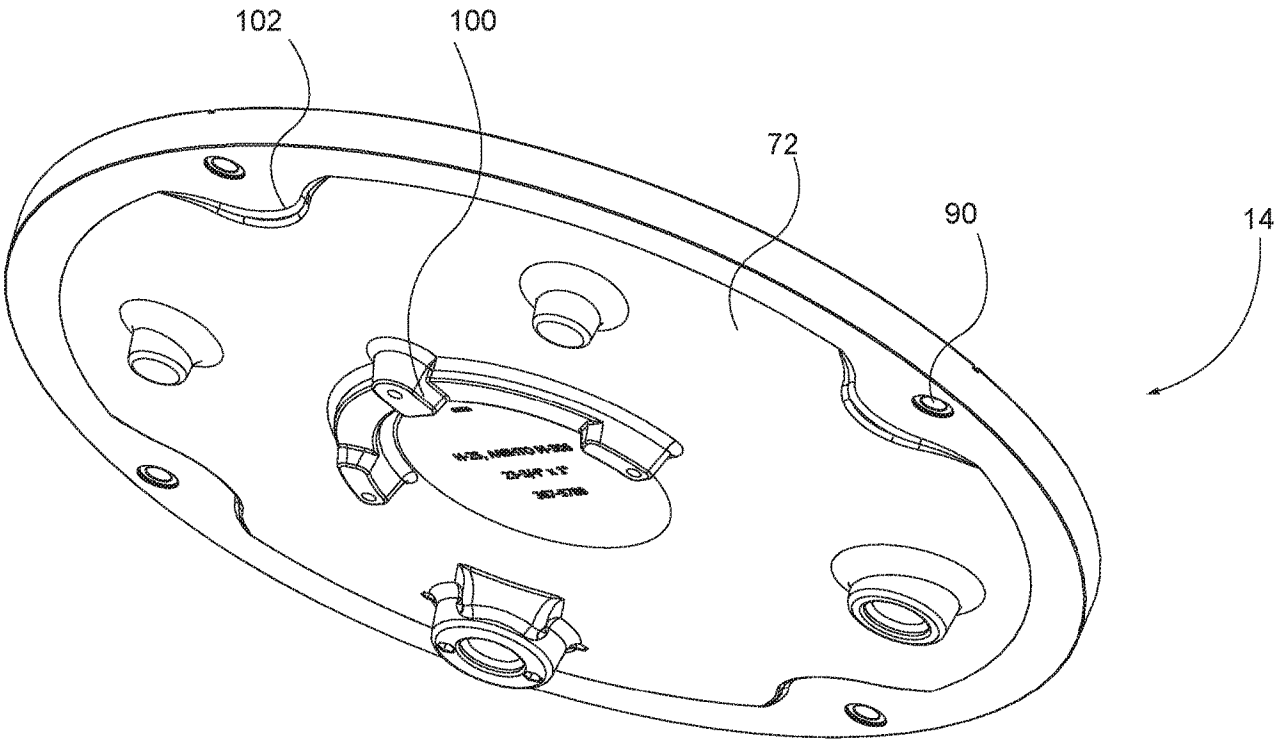
FIG. 10 is a bottom perspective view of a cover of the cover assembly.

Turning now to FIG. 10 in addition to FIGS. 1 and 2, the cover 14 includes an upper surface 70 and a lower surface 72 configured to abut the upper surface 42 of the lip 32 such that the upper surface 70 of the cover 14 is substantially flush with the upper surface 22 of the frame 12. The upper surface 70 of the cover 14 may have any suitable finish, such as a textured finish over some or all of the surface to provide for increased traction, and may additionally include areas for indicia, for example area 74 identifying the usage of the cover assembly 10, such as sanitary sewer.

The cover includes a first depression 76 in the upper surface 70. A pick bar 78, which may be any suitable material, such as steel, and which may be any suitable shape, such as rectangular, is secured to the upper surface 70 of the cover 14 above the depression 76. In the illustrated embodiment, the pick bar 78 is disposed in a second depression 80 perpendicular to the first depression such that an upper surface 82 of the pick bar 78 is substantially flush with the upper surface 70 of the cover 14. The pick bar 78 is secured in the second depression 80 in any suitable manner, such as by a plurality of fasteners 84 that extend through openings in the pick bar and into openings in the second depression 80. When secured to the cover 14, the pick bar 78 forms with the first depression 76 an area for receiving a tool, such as a pry bar or manhole hook, to allow a user to remove the cover 14 from the frame 12.

The cover 14 additionally includes a plurality of circumferentially spaced openings 90 extending through the cover 14 that are configured to be aligned with the openings 46 in the lip 32 to receive fasteners 92 to secure the cover 14 to the frame 12. In the illustrated embodiment the cover 14 includes four openings equally spaced around the cover 14, although it will be appreciated that any suitable number of openings may be provided that have any suitable shape. The openings 90 are provided near an edge of the cover 14 and each include a counterbore for receiving a head of one of the fasteners 92 to allow the fastener to be flush with or below the upper surface 70 of the cover 14.

Adjacent at least one of the openings 90, and in the illustrated embodiment adjacent each opening 90 is an alignment indicator 94 on the upper surface 70 of the cover 14. Each of the alignment indicators 94 is aligned with one of the openings 90 along a line parallel to a plane of the upper surface 70. The alignment indicators 94 are shown as indentations in the upper surface 70 of the cover 14, although it will be appreciated that the alignment indicators 94 may be any suitable indicator, such as a line, a geometric shape, a raised portion, etc.

With continued reference to FIG. 10, the cover 14 includes one or more studs 100 extending from the lower surface 72 for attaching a flow monitoring, water meter radio transmitter, and/or leak detection device and/or other suitable device. The flow monitoring/leak detection device may be attached to the stud 100 by a suitable fastener, or alternatively may be attached to a bracket that is attached to the stud. Additionally or alternatively, the lower surface 72 of the cover 14 may include one or more cutouts in which the flow monitoring/leak detection device may be at least partially inserted to increase the stability of the connection between the flow monitoring/leak detection device and the cover 14. The polymer material of the cover 14 allows the flow monitoring/leak detection/water meter radio transmitter device to wirelessly communicate a transmission to a location above ground to eliminate the need for an operator to access the flow monitoring/leak detection device to obtain information.

The cover 14 additionally includes one or more lobe areas 102, and in the illustrated embodiment a lobe area 102 near each opening 90. Each lobe area 102 mates with one of the inward extending lobes 36 of the lip 32 when the alignment indicators 60 of the frame 12 are aligned with the alignment indicators 94 of the cover 14 to allow the cover 14 to be seated against the lip 32. It will be appreciated that if the lobes 36 extend outward, the lobe area 102 may also extend outward or the lobe and lobe areas may extend in another suitable direction. The lobe areas 102 also serve to prevent rotation of the cover 14 relative to the frame 12 before the fasteners 92 secure the cover 14 to the frame 12. If the alignment indicators 60 and 94 are not properly aligned, the lobes 36 will not mate with the lobe areas 102 and will prevent the cover 14 from seating against the lip 32, thereby providing an additional visual indication to the user that the cover 14 is not properly aligned with the frame 12.

Referring again to FIGS. 1, 2, 8, and 9, to install the cover assembly 10 over a manhole, the frame 12 is inserted over the manhole such that the lower surface 24, which is formed by the lower surface of the flange 62, sits on the manhole. The frame 12 is then secured to the ground in a suitable manner, such as by fasteners extending through the slots 64 in the flange 62. The frame 12 may be installed with the cover 14 secured to it or with the cover 14 removed from it.

After the frame 12 is installed, to secure the cover 14 to the frame 12, the cover 14 is lowered into the through passage 30 and rotated as needed to align the alignment indicators 94 on the cover 14 with the alignment indicators 60 on the frame 12, thereby aligning the lobe areas 102 extending from the lower surface 72 of the cover 14 with the lobes 36 of the lip 32. The cover 14 is lowered until the lower surface 72 of the cover 14 abuts the upper surface 42 of the lip 32. When abutting the lip 32, the cover 14 compresses the sealing device 40 to create a seal between the cover 14 and the frame 12. The fasteners 92 are then inserted through the openings 90 and rotated or otherwise moved to engage with the openings 46 in the lip 32 to couple the cover 14 to the frame 12. By providing the openings 46 in the securement areas 44 radially outwardly spaced from the sealing device 40, the cover 14 is secured to the frame 12 without affecting the seal created between the cover 14 and the frame 12, thereby preventing the infiltration of unwanted substances into the through passage 30.

It will be appreciated that the fasteners 92 may alternatively already extend through the openings 90 and in an embodiment may be held in the openings 90 in a suitable manner.

If the alignment indicators 94 are not aligned with the alignment indicators 60, and thus the upper surface 70 of the cover 14 is not substantially flush with the upper surface 22 of the body 20, the cover 14 is rotated, for example using a tool that engages the pick bar 78, until the alignment indicators 60 are aligned with the alignment indicators 94 causing the cover 14 to fall into place. The fasteners 92 then secure the cover 14 to the frame 12 as discussed above. The use of the alignment indicators 60 and 94 with the lobes 36 and the lobe area 102 ensure that the cover 14 is properly aligned with the frame 12, thereby ensuring the cover 14 is sealed to the frame 12 and ensuring the openings 46 and 90 are aligned when the openings 46 are not visible.

To remove the cover 14 from the frame 12, the fasteners 92 are loosened and removed from the openings 46 in the lip 32. The fasteners 92 may then be removed from the cover 14 or be retained in the cover 14, such as by a C-clip or other suitable retainer secured to the bottom of each fastener 92. The user then engages the pick bar 78 with the tool and moves the cover 14 away from the frame 12 to allow a user access to the manhole.

Figure 12:
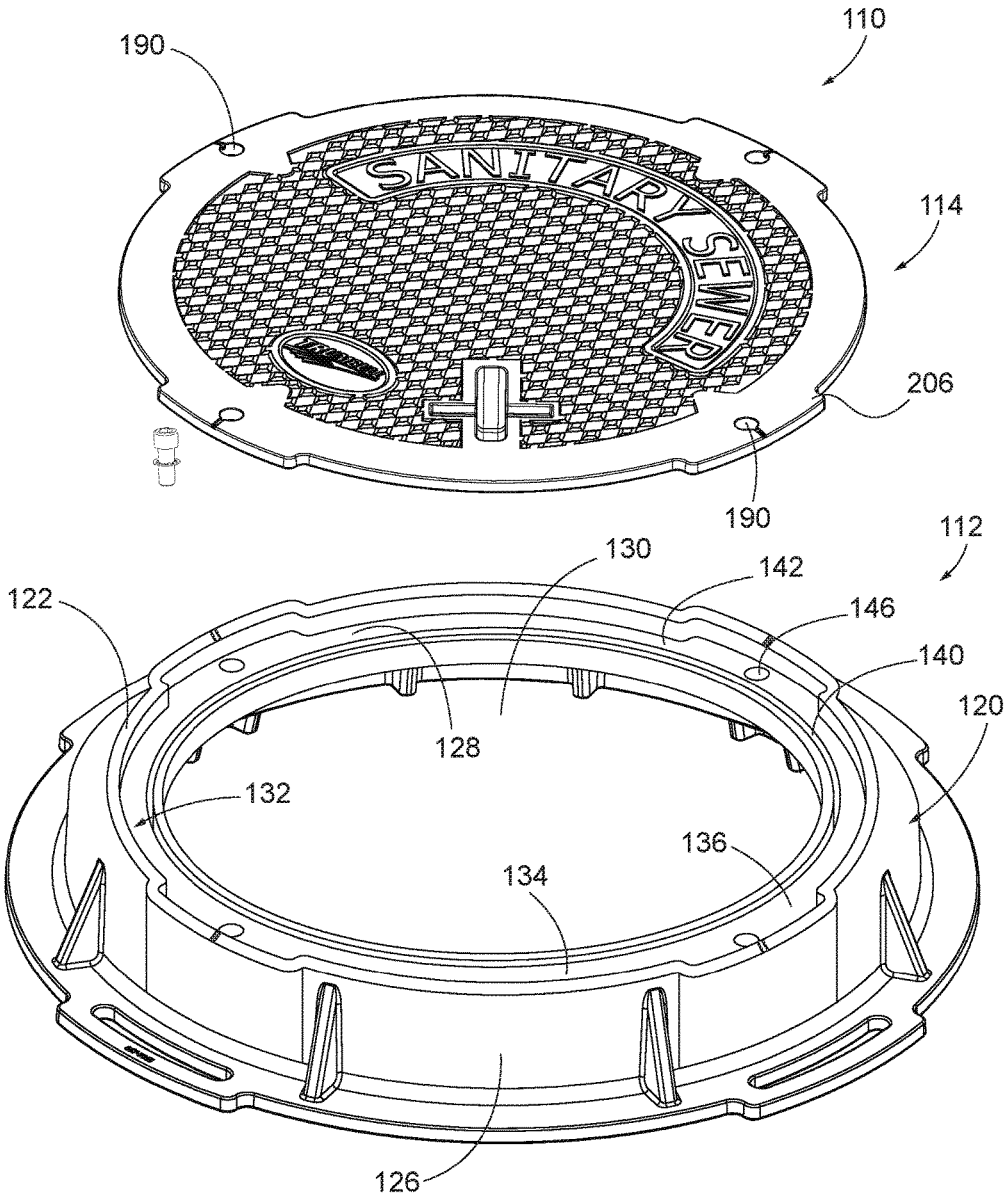
FIG. 12 is a top perspective view of another exemplary cover assembly.

Turning now to FIG. 12, an exemplary embodiment of the cover assembly is shown at 110. The cover assembly 110 is substantially the same as the above-referenced cover assembly 10, and consequently the same reference numerals but indexed by 100 are used to denote structures corresponding to similar structures in the cover assemblies. In addition, the foregoing description of the cover assembly 10 is equally applicable to the cover assembly 110 except as noted below.

The cover assembly 110 includes a frame 112 that is secured to the manhole and a cover 114 that is removably connected to the frame 112. The frame 112 includes a body 120 having an upper surface 122, a lower surface, an outer surface 126, and an inner surface 128 defining a through passage 130, and a lip 132 extending inward from the inner surface 128 around a circumference of the inner surface 128. The lip 132 includes a main body portion 134 extending inward from the inner surface 128 and a plurality of circumferentially spaced lobes 136 extending outward from the main body portion 134. In the illustrated embodiment the inner and outer surfaces 128 and 126 extend outwardly at defined positions to define the lobes 136 and form an area for receiving lobes 206 of the cover 114. It will be appreciated that the main body portion may extend outward or alternatively the frame 112 may include outwardly extending lobes extending outward from the upper surface 122. A circumferential seal groove 140 for receiving a seal extends around an upper surface 142 of the lip 132 spaced from the inner surface 128 of the body 120 such that the circumferential groove 140 extends inward from the openings 146.

The cover 114 includes a plurality of circumferentially spaced openings 190 extending through the cover 114 that are configured to be aligned with the openings 146 in the lip 132 to receive respective fasteners, one of which is shown with a retainer. The cover 114 also includes the plurality of circumferentially spaced lobes 206 extending outward from an outer periphery of the cover 114. The openings 190 may extend through or partially extend through the lobes 206. When the cover 114 is lowered onto the frame 112, the lobes 206 are aligned with and received in the corresponding areas.

It will be appreciated that the frame and cover and other components of the cover assembly may be any suitable shape, such as circular, square, rectangular, oval shaped, polygonal, etc., and the use of the word circumference or circumferentially is used to define a boundary of the shape.

Although certain embodiments have been shown and described, it is understood that equivalents and modifications falling within the scope of the appended claims will occur to others who are skilled in the art upon the reading and understanding of this specification.

What is claimed is:

1. A cover assembly comprising:

a frame including:

a body having an upper surface, a lower surface, an outer surface, and an inner surface defining a through passage; and a lip extending inward from the inner surface around a circumference of the inner surface, the lip having a main body portion extending inward from the inner surface, a plurality of circumferentially spaced lobes extending inward from the main body portion, and a circumferential groove that extends around the main body portion and inward with the plurality of circumferentially spaced lobes thereby forming securement areas on the main body portion of the lip between the circumferential groove and the inner surface of the body for receiving fasteners;

a sealing device disposed within the groove; and a cover configured to be removably connected to the frame, wherein a lower surface of the cover is configured to abut the upper surface of the lip and seal to the frame via the sealing device, wherein the cover is configured to be removably connected to the frame without interfering with the seal.

2. The cover assembly according to claim 1, wherein the lip includes a plurality of circumferentially spaced openings in the securement areas.

3. The cover assembly according to claim 1, wherein the cover includes a plurality of circumferentially spaced openings extending therethrough and the lip includes a plurality of circumferentially spaced openings in the upper surface, and wherein the plurality of circumferentially spaced openings in the cover and the lip are configured to be aligned.

4. The cover assembly according to claim 3, further including a plurality of fasteners, wherein one of the plurality of fasteners is configured to extend through each of the openings in the cover and into one of the openings in the lip to secure the cover to the frame.

5. The cover assembly according to claim 3, wherein the body includes a plurality of alignment indicators on its upper surface each aligned with one of the plurality of openings in the lip, wherein the cover includes a plurality of alignment indicators on its upper surface each aligned with one of the openings in the cover, and wherein each of the alignment indicators on the cover is configured to be aligned with one of the alignment indicators on the body to align the openings in the cover with the openings in the lip.

6. The cover assembly according to claim 1, wherein the lip is perpendicular to the inner surface of the body and spaced below the upper surface of the body such that when the cover abuts the lip, an upper surface of the cover is substantially flush with the upper surface of the body.

7. The cover assembly according to claim 1, wherein the cover includes one or more studs extending from the lower surface for attaching a monitoring/detection device.

8. The cover assembly according to claim 1, wherein the frame further includes a flange extending around the outer surface of the body, the flange having one or more slots for anchoring the frame to a manhole.

9. The cover assembly according to claim 1, wherein the cover includes a depression in the upper surface and the assembly further includes a pick bar secured to the upper surface of the cover above the depression, and wherein the depression/pick bar form an area for receiving a tool to allow a user to remove the cover from the frame.

10. The cover assembly according to claim 1, wherein the body includes a plurality of alignment indicators on its upper surface and the cover includes a plurality of alignment indicators on its upper surface, and wherein each of the alignment indicators on the cover is configured to be aligned with one of the alignment indicators on the body.

11. A cover assembly comprising:

a frame including:

a body having an upper surface with a plurality of circumferentially spaced body alignment indicators, a lower surface, an outer surface, and an inner surface defining a through passage; and a lip including a main body portion extending inward from the inner surface around a circumference of the inner surface, a plurality of circumferentially spaced lobes extending inward from the main body portion, a circumferential groove that extends around the main body portion and inward with the plurality of circumferentially spaced lobes, and a plurality of circumferentially spaced openings between the circumferential groove and the inner surface of the body that are respectively aligned with one of the plurality of circumferentially spaced body alignment indicators; and a cover configured to be removably connected to the frame, the cover having an upper surface with a plurality of circumferentially spaced cover alignment indicators, a lower surface configured to abut the upper surface of the lip, and a plurality of circumferentially spaced openings respectively aligned with one of the plurality of circumferentially spaced cover alignment indicators and extending through the cover, wherein each of the cover alignment indicators is configured to be aligned with one of the body alignment indicators to align the openings in the cover with the openings in the lip.

12. The cover assembly according to claim 11, further including a plurality of fasteners, wherein one of the plurality of fasteners is configured to be received in each of the openings in the cover when aligned with the one of the openings in the lip to removably connect the cover to the frame.

13. The cover assembly according to claim 11, wherein the frame further includes a flange extending around the outer surface of the body, the flange having one or more slots for anchoring the frame to a manhole.

14. The cover assembly according to claim 11, wherein the lip includes a plurality of inward extending lobes and the cover includes a plurality of corresponding portions that are configured to mate with the lobes when the alignment indicators are aligned.

15. A cover assembly comprising:

a frame including:

a body having an upper surface with a plurality of circumferentially spaced body alignment indicators, a lower surface, an outer surface, and an inner surface defining a through passage; and a lip extending inward from the inner surface around a circumference of the inner surface, the lip having a main body portion extending inward from the inner surface, a plurality of circumferentially spaced lobes extending inward from the main body portion, and a circumferential groove that extends around the main body portion and inward with the plurality of circumferentially spaced lobes thereby forming securement areas on the main body portion of the lip between the circumferential groove and the inner surface of the body for receiving fasteners;

a sealing device disposed within the groove; and a cover configured to be removably connected to the frame, the cover having an upper surface with a plurality of circumferentially spaced cover alignment indicators and a lower surface configured to abut the upper surface of the lip, wherein each of the alignment indicators on the cover is configured to be aligned with one of the alignment indicators on the body.

* * * * *